US009492009B2

(12) United States Patent
Naka et al.

(10) Patent No.: US 9,492,009 B2
(45) Date of Patent: Nov. 15, 2016

(54) COLLAPSIBLE AND STACKABLE PARTS RACK

(71) Applicant: Honda Logistics North America, Inc., East Liberty, OH (US)

(72) Inventors: Masaaki Naka, Suzuka (JP); Nobuhiro Maeda, Suzuka (JP)

(73) Assignee: HONDA LOGISTICS NORTH AMERICA, INC., East Liberty, OH (US)

( * ) Notice: Subject to any disclaimer, the term of this patent is extended or adjusted under 35 U.S.C. 154(b) by 0 days.

(21) Appl. No.: 14/211,654

(22) Filed: Mar. 14, 2014

(65) Prior Publication Data

US 2015/0257530 A1 Sep. 17, 2015

(51) Int. Cl.

| | |
|---|---|
| ***A47B 43/00*** | (2006.01) |
| ***A47B 47/00*** | (2006.01) |
| ***A47B 55/00*** | (2006.01) |
| ***A47B 57/32*** | (2006.01) |
| ***A47B 47/02*** | (2006.01) |
| ***A47B 47/03*** | (2006.01) |
| *A47B 87/02* | (2006.01) |

(52) U.S. Cl.

CPC ..... *A47B 47/0091* (2013.01); *A47B 47/005* (2013.01); *A47B 47/0025* (2013.01); *A47B 47/021* (2013.01); *A47B 47/03* (2013.01); *A47B 55/00* (2013.01); *A47B 57/32* (2013.01); *A47B 43/00* (2013.01); *A47B 47/00* (2013.01); *A47B 87/02* (2013.01)

(58) Field of Classification Search

CPC ..... A47B 47/0091; A47B 47/0025; A47B 47/005; A47B 55/00; A47B 57/32; A47B 43/00; A47B 87/02; A47B 87/0223; A47B 87/0207; A47B 47/00; A47B 47/021; A47B 47/03; B65D 2519/00935; B65D 2519/0096; B65D 19/385

USPC ..... 211/194, 195, 189, 38, 85, 132.1, 211/133.1, 133.3, 167; 108/53.1, 53.3, 108/53.5, 91; 206/600, 503, 509, 511, 512

See application file for complete search history.

(56) References Cited

U.S. PATENT DOCUMENTS

| | | | | |
|---|---|---|---|---|
| 1,099,849 | A * | 6/1914 | Hammond | 108/60 |
| 2,579,655 | A * | 12/1951 | Donald | 220/6 |
| 2,679,321 | A * | 5/1954 | Koeferl | 211/50 |

(Continued)

*Primary Examiner* — Joshua J Michener
*Assistant Examiner* — Devin Barnett
(74) *Attorney, Agent, or Firm* — Standley Law Group LLP

(57) ABSTRACT

A rack for holding articles, components, parts and other such items and further being collapsible and stackable upon other similar racks whether any of the racks are in an upright or collapsed position. The rack includes a shelf and a plurality of leg assemblies distributed about the shelf perimeter, the leg assemblies each having a leg footer, a leg member, and a slider pivot bearing joining the proximal ends of the leg footer and leg member thereby constraining relative motion between the leg footer and leg member to two degrees of freedom. Embodiments of the rack further include retaining tabs on the leg member and corresponding notches on the leg footer to lock leg members in the upright position. Pairs of leg assemblies may be connected by primary connecting frame elements forming a portion of the perimeter, with the pairs being connected by secondary connecting frame elements forming another portion of the perimeter.

4 Claims, 4 Drawing Sheets

(56) References Cited

U.S. PATENT DOCUMENTS 2,699,911 A * 1/1955 Chase et al. ..... 108/53.5
2,741,391 A * 4/1956 Belanger ..... 220/6
2,863,566 A * 12/1958 White ..... B65G 1/02 211/41.14
2,956,763 A * 10/1960 D'Arca ..... 108/53.1
3,147,860 A * 9/1964 Kean, Sr. ..... B65D 19/08 108/53.5
3,163,296 A * 12/1964 Hohnstein ..... 211/126.6
3,459,326 A * 8/1969 Betjemann ..... 220/1.5
3,499,398 A 3/1970 Murray
3,620,388 A * 11/1971 Mansson ..... B65D 88/129 108/53.1
3,665,869 A * 5/1972 Howe ..... 108/53.1
3,735,713 A * 5/1973 Glassmeyer ..... 108/53.5
3,804,033 A 4/1974 Izawa et al.
3,994,241 A * 11/1976 Evans ..... B65D 19/385 108/53.5
4,162,737 A * 7/1979 Clive-Smith ..... 220/1.5
4,240,359 A * 12/1980 Howe ..... 108/53.1
4,258,631 A 3/1981 Brown
4,339,047 A * 7/1982 Johansson et al. ..... 220/1.5
4,489,835 A * 12/1984 Tombal ..... B65D 85/48 206/448
4,638,744 A * 1/1987 Clive-Smith ..... 108/56.1
4,662,532 A * 5/1987 Anderson et al. ..... 220/7
4,735,330 A * 4/1988 Hoss ..... 220/6
4,773,547 A * 9/1988 Bell ..... 211/194
5,037,256 A * 8/1991 Schroeder ..... B61D 45/006 403/325
5,141,114 A * 8/1992 Cate et al. ..... 211/85.8
5,228,821 A * 7/1993 Gleffe et al. ..... 414/403
5,242,255 A * 9/1993 Gleffe et al. ..... 414/403
5,326,204 A * 7/1994 Carlson ..... A47B 96/1466 211/183
5,415,311 A * 5/1995 Coogan ..... 220/6
5,644,992 A * 7/1997 Clive-Smith ..... 108/55.1
5,692,625 A * 12/1997 Filipescu et al. ..... 211/195
5,833,074 A * 11/1998 Phillips ..... 211/21
5,941,398 A * 8/1999 Harris ..... 211/60.1
D442,759 S * 5/2001 Bowman ..... D34/38
D446,052 S * 8/2001 Bourne ..... D6/678.4
6,279,763 B1 * 8/2001 Bush ..... 211/195
6,325,224 B1 * 12/2001 Brown ..... 211/194
6,513,442 B1 * 2/2003 Miller et al. ..... 108/53.1
D487,365 S * 3/2004 Bourne ..... D6/675
6,842,665 B2 * 1/2005 Karlen ..... 700/217
7,001,130 B2 * 2/2006 Ransom ..... B25J 17/0208 206/448
7,021,461 B1 * 4/2006 Robey ..... B60P 3/07 206/335
D534,329 S * 12/2006 Bourne ..... D34/38
7,178,680 B2 * 2/2007 Botner ..... 211/34
D541,555 S * 5/2007 Falland ..... D6/675.5
7,270,236 B2 * 9/2007 Angeletti et al. ..... 206/448
7,293,946 B1 * 11/2007 Fuller ..... B60P 7/13 410/143
7,387,215 B1 * 6/2008 Grigsby, Sr. ..... 217/45
D603,123 S * 10/2009 Canters ..... D34/38
7,624,887 B2 * 12/2009 Avery ..... 220/9.2
7,971,733 B2 * 7/2011 Ponto ..... B65D 19/44 108/55.1
7,992,738 B2 * 8/2011 Gao et al. ..... 220/4.27
8,002,128 B2 * 8/2011 Kern et al. ..... 211/194
8,434,631 B2 5/2013 Harpole
8,578,862 B1 * 11/2013 Shirley ..... A47B 85/06 108/12
D706,013 S * 5/2014 Kupferschlager ..... D34/38
2002/0088766 A1 * 7/2002 Flores ..... 211/194
2003/0164318 A1 * 9/2003 Lacasse ..... B65D 85/48 206/448
2005/0188901 A1 * 9/2005 Arai et al. ..... 108/53.1
2006/0091096 A1 * 5/2006 Velez et al. ..... 211/194
2006/0279185 A1 * 12/2006 Magderburg ..... 312/257.1
2008/0217276 A1 * 9/2008 Brady et al. ..... 211/195
2008/0237168 A1 * 10/2008 Harpole ..... 211/195
2009/0044732 A1 * 2/2009 MacKenzie ..... 108/53.3
2009/0057191 A1 * 3/2009 Temple et al. ..... 206/600
2009/0120887 A1 * 5/2009 Meehan ..... 211/85.8
2011/0180505 A1 * 7/2011 Noniewicz et al. ..... 211/195
2011/0192760 A1 * 8/2011 Joubert ..... 206/600
2011/0253656 A1 * 10/2011 Vermeer ..... 211/85.8
2012/0074084 A1 * 3/2012 Barber et al. ..... 211/85.8

* cited by examiner

COLLAPSIBLE AND STACKABLE PARTS RACK

CROSS-REFERENCE TO RELATED APPLICATIONS

This application makes no priority claim.

TECHNICAL FIELD

Exemplary embodiments of the present invention relate generally to parts racks used with assembly lines, and more specifically to collapsible racks that are stackable whether in a collapsed or upright position.

BACKGROUND OF THE INVENTION

Many forms of racks, stands, shelves and other such support structures, hereinafter referred to simply as "racks," have been used for holding articles. Portable racks are used in manufacturing environments to deliver parts to an assembly line for inclusion in or preparation for inclusion in a manufacturing product. Racks are also used to provide uniform storage for articles, parts or components, and further in situations in which transportation and delivery of such items is needed.

Racks are numerous in design, and attempts to improve upon them have been made in the past to suit a variety of needs. One general improvement has been to provide for collapsible racks that may be collapsed, folded or dismantled when not in use, primarily to reduce to the space needed to transport empty racks back to their point of origin. Another general improvement has been to provide for stackable racks that are configured to be stacked vertically on top of other similar racks to utilize space in storage and transportation circumstances.

In both cases, rack designs have been used that provide various advantages and disadvantages to the user. For example, some designs have utilized foldable opposing end frames that, while providing strength and stability, interfere with the rack surface when in a collapsed position. This becomes a disadvantage in manufacturing situations wherein it is preferable for the rack surface of the topmost rack in a vertical stack to be freely accessible to assembly line workers or machines picking parts and components from the rack for utilization on the assembly line. Therefore, it is preferable for racks to be collapsible so that structural components do not interfere with the rack surfaces or the parts stored thereon.

Other racks designs provide collapsibility via dismantling. However, this is not desirable for situations in which quick and safe removal of the rack from an active area is needed, as is the case for assembly lines. Disaggregate rack components may pose a safety hazard if not secured properly in and around assembly line areas, and on board transportation vehicles. Furthermore, separable components generally result in much longer breakdown times for racks. For these reasons, racks with removable components are not favored.

Various hinge or bearing mechanisms have been used to enable folding of leg or frame structures relative to the rack surface or base. It has also been recognized that it is desirous for safety and convenience reasons to avoid bearing designs in which components protrude from the jointed areas which may in turn catch on clothing, machinery, or the articles or parts themselves. To avoid such issues, some designs have utilized a leg or post configuration wherein the leg or support posts slide into or around another structural component of the rack. These designs have often suffered from shaky stability due to loose-fitting parts. Various elaborate mating cuts and welded components have been introduced to increase strength and stability of such configurations, but at the cost of increased production difficulty, expense and complication, and often introduce disadvantages such as protruding components that are undesirable for the reasons mentioned above.

It is therefore an unmet need in the prior art for a collapsible rack that is stackable upon other similar racks when in both the upright and collapsed positions, that has foldable legs that do not interfere with or inhibit access to the rack surface when in the collapsed position, has movable components that remain within the footprint of the rack regardless of position, that has a hinging mechanism that contains no protruding parts and requires no welding or intricate mating surface finishing, that has no separable, removable parts, and that may be quickly collapsed and unfolded in a safe manner.

BRIEF SUMMARY OF THE INVENTION

One object of the invention is to provide a collapsible and portable rack that is stackable upon other similar racks whether any one rack is in an upright (e.g., unfolded or active) or a collapsed (e.g., folded or inactive) position.

Another object of the invention is to provide a rack with a shelf having a top surface and a perimeter, and further at least three leg assemblies distributed symmetrically about the perimeter, wherein each leg assembly is provided with a leg footer affixed to the perimeter and having a proximal end, a distal end and a bearing bracket at the proximal end, a leg member having a proximal end and a distal end wherein the proximal end of the leg member is shaped to be received into the bearing bracket, and a slider pivot bearing joining the leg member to the bearing bracket at a pivot axis and having a journal in contact with a linear bearing surface and a circular bearing surface, wherein the slider pivot bearing constrains, via the journal, the pivot axis to linear motion along the linear bearing surface and axial rotation along the circular bearing surface.

It is another object of the invention to provide a rack with a retaining tab protruding from the leg member and a notch in the bearing bracket shaped to receive the retaining tab, thereby locking the slider pivot bearing against axial rotation when the leg member is in an upright position.

Further objects of the invention are provided in racks having an upright position wherein the leg member extends vertically from the leg footer wherein the retaining tab is retained within the notch, and a collapsed position wherein the leg member is slid upward so that the retaining tab is released from the notch and the leg member is pivoted into a horizontal position, thereby extending horizontally from an opening in the leg footer body.

Yet another object of the invention is to provide a leg footer with a stacking socket at the distal end of the leg footer sized to receive from a second rack for stacking thereon a distal end of a leg member or a proximal end of a leg footer.

Another object of the invention is provided in a rack with at least two leg assembly pairs spaced apart about the perimeter, wherein each leg assembly pair comprises a first leg assembly and a second leg assembly joined by a primary connecting frame element that forms a portion of the perimeter. Racks may also be provided with a secondary connecting frame element joining perimetrically adjacent leg assembly pairs in the at least two leg assembly pairs, wherein the secondary connecting frame element forms a portion of the perimeter.

It is another object of the invention to provide a rack wherein the journal is carried by a shaft pin coaxial with the pivot axis, the linear bearing surface being an interior surface of a slot through the leg member and the circular bearing surface being an interior surface of a hole through the bearing bracket of the leg footer. Alternatively, the linear bearing surface may be an interior surface of a slot through the bearing bracket of the leg footer and the circular bearing surface may be an interior surface of a hole through the leg member.

It is another object of the invention to provide a rack with spaced apart fork guides affixed to the rack in parallel beneath the shelf.

It is another object of the invention to provide a rack with a plurality of tie-downs affixed to the rack, a plurality of mounting brackets affixed to the shelf, and a plurality of mounting holes through the shelf.

It is another object of the invention to provide a rack with a shelf having a top surface, a perimeter and a geometric center, and further a plurality of leg assemblies distributed about the perimeter in rotational symmetry with respect to the geometric center. Each leg assembly has a leg member having an outer surface, a maximum leg member width, a proximal end and a distal end, and further includes a bearing surface being closed and extending through the proximal end of the leg member, and a retaining tab protruding from the outer surface longitudinally between the bearing surface and the distal end of the leg member body. Each leg assembly further has a leg footer having a proximal end and a distal end, is affixed to the perimeter, and further includes a tubular shell body having an interior shape sized to receive the proximal end of the leg member, a notch sized to receive the retaining tab formed in and open to the proximal end of the leg footer, a bearing surface being closed and extending through the proximal end of the leg footer, an opening in the leg footer extending longitudinally from the proximal end of the leg footer having a transverse width greater than the maximum leg member width, and a stacking socket extending from the distal end of the leg footer sized to receive from a second rack for stacking thereon a distal end of a leg member or a proximal end of a leg footer. Each leg assembly further includes a slider pivot bearing connecting the proximal end of the leg member to the proximal end of the leg footer and has a shaft pin secured within the bearing surface of the leg footer and the bearing surface of the leg member wherein the proximal end of the leg member is contained within the tubular shell of the leg footer, the leg member being thereby movable between the upright position and the collapsed position.

Another object of the invention is provided wherein the bearing surface of the leg footer is a circular bearing surface being an interior surface of a hole and the bearing surface of the leg member is a linear bearing surface being an interior surface of a slot, whereby the shaft pin constrains the leg member to linear motion with respect to the shaft pin, and the leg footer and leg member are constrained to axial rotation about the shaft pin with respect to one another.

Another object of the invention is provided wherein the bearing surface of the leg member is a circular bearing surface being an interior surface of a hole and the bearing surface of the leg footer is a linear bearing surface being an interior surface of a slot, whereby the shaft pin is constrained to linear motion with respect to the leg footer, and the leg footer and leg member are constrained to axial rotation about the shaft pin with respect to one another.

It is another object of the invention to provide a rack with a shelf having a top surface and a first and second pair of parallel sides together forming a perimeter, and further pair of primary support structures each having a pair of leg assemblies. Each leg assembly has a leg member having a proximal end and a distal end, and further includes a leg member body having a pair of opposing sides each having an outer surface and together defining a maximum leg member width there between, a pair of slots in the pair of opposing sides and extending longitudinally from the proximal end of the leg member, and a retaining tab protruding from the outer surface of each opposing side and located longitudinally between the slot and the distal end of the leg member. Each leg assembly is further provided with a leg footer having a proximal end and a distal end, and further includes a leg footer body having a U-channel shell with two parallel sides defining an interior diameter greater than the maximum leg member width, a perpendicular side joining the two parallel sides and an open side, further a notch sized to receive the retaining tab formed in and open to the proximal end of the leg footer on each parallel side of the leg footer body, a hole formed in the proximal end of the leg footer on each parallel side of the leg footer body, and a stacking socket at the distal end of the leg footer sized to receive from a second rack for stacking thereon a distal end of a leg member or a proximal end of a leg footer body. Each leg assembly further includes a slider pivot bearing securing the proximal end of the leg member within the proximal end of the leg footer and has a shaft pin secured through each hole in the leg footer and each slot in the leg member wherein the proximal end of the leg member is contained within the leg footer, the leg member being thereby movable between the upright position and the collapsed position. Each pair of leg assemblies further includes a primary connecting frame element affixed between and joining the pair of leg assemblies to form the primary support structure, and wherein the pair of primary support structures are each affixed to a side in the first pair of parallel sides of the shelf. The rack is further provided with a pair of secondary connecting frame elements each affixed between a joining a leg assembly from each of the primary support structures, and wherein the pair of secondary connecting frame elements are each affixed to a side in the second pair of parallel sides of the shelf.

It is an object of this invention to provide a collapsible and stackable rack of the type generally described herein and being adapted for the purposes set forth herein, and overcoming disadvantages found in the prior art. These and other advantages are provided by the invention described and shown in more detail below.

BRIEF DESCRIPTION OF THE SEVERAL VIEWS OF THE DRAWINGS

Novel features and advantages of the present invention, in addition to those mentioned above, will become apparent to those skilled in the art from a reading of the following detailed description in conjunction with the accompanying drawings wherein identical reference characters refer to identical parts and in which.

DETAILED DESCRIPTION OF THE INVENTION

Figure 1:
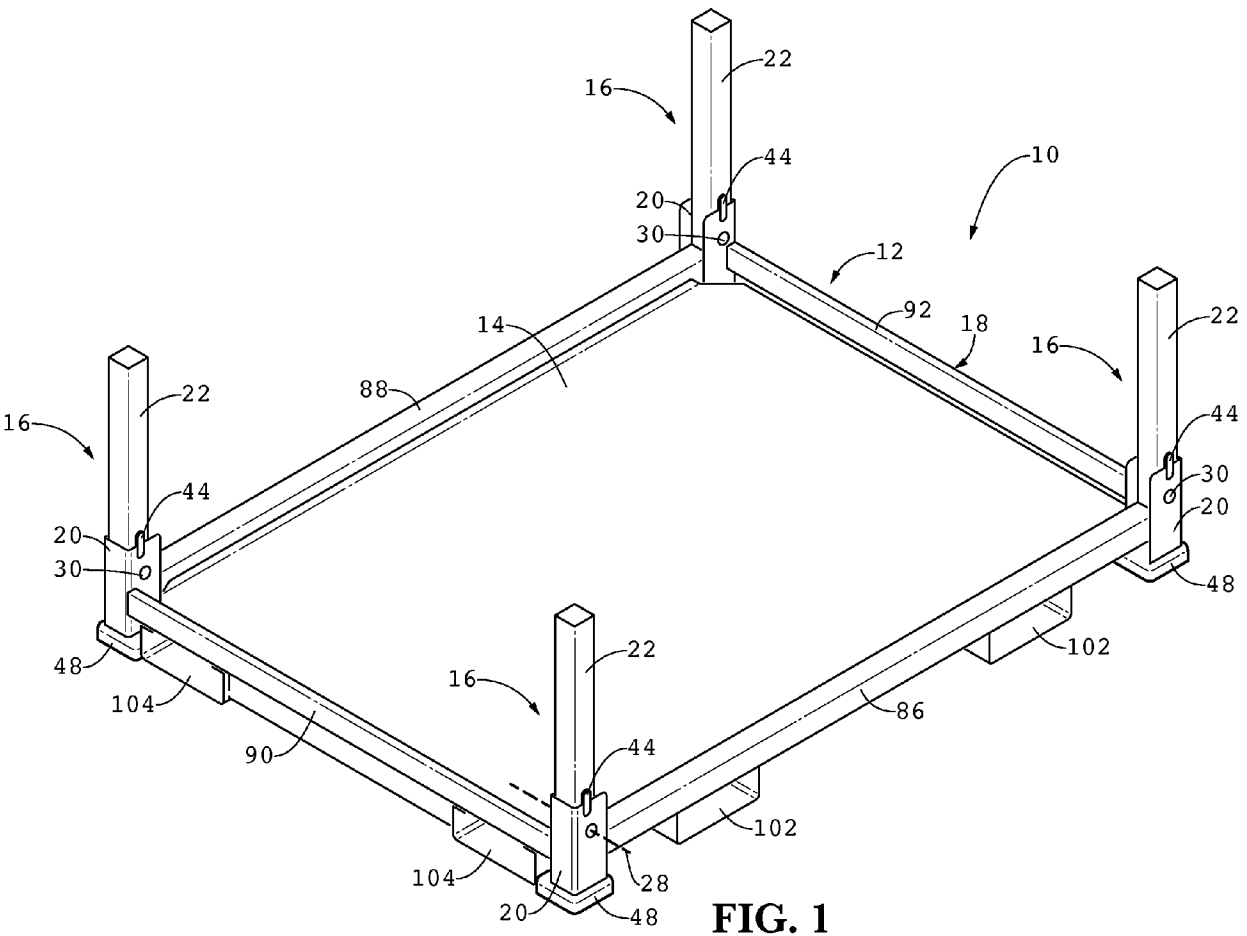
FIG. 1 is a perspective view of an exemplary rack in the upright position.
Figure 4:
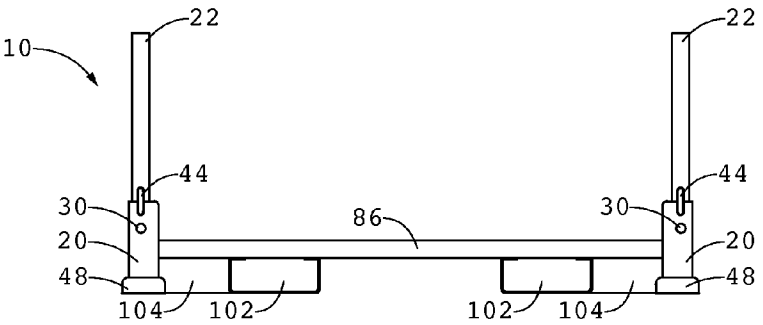
FIG. 4 is a front elevation view of the exemplary rack.
Figure 3:
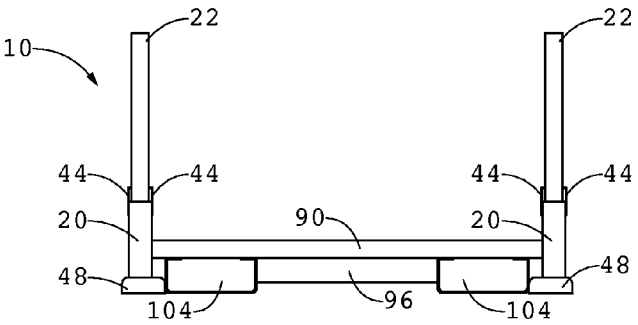
FIG. 3 is a side elevation view of the exemplary rack.
Figure 5:
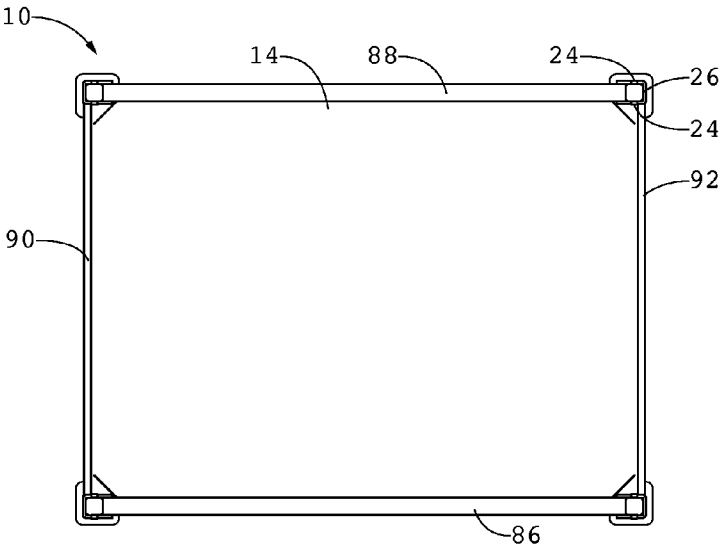
FIG. 5 is a top plan view of the exemplary rack.

Exemplary embodiments of the present invention are directed to improved collapsible racks that are stackable whether in a collapsed or upright position, and being generally adapted for the purposes and advantages as set forth herein. One such exemplary embodiment of a rack 10 is shown in perspective view in an upright position in FIG. 1, in a side elevation view in FIG. 3, in a front elevation view in FIG. 4, in a top plan view in FIG. 5, and in a bottom plan view in FIG. 6. The rack 10 has a shelf 12 with a top surface 14 on which various articles or parts and components thereof (not shown) may be placed for storage, transport or the like. Preferably, the shelf 12 includes a single continuous top surface 14, but may also be provided as a series of slats, as a lattice structure, or other such discontinuous surface configurations. The shelf 12 depicted in the exemplary embodiment shown in FIG. 1 is substantially rectangular in shape, but can be any shape desired that is practicable for stability of the rack 10.

At least three leg assemblies 16 are included and distributed about the perimeter 18 of the shelf 12. The leg assemblies 16 are preferably distributed symmetrically about the perimeter 18 to ensure stability and to assist in achieving proper orientation of the racks with respect to other racks during stacking. As explained in further detail below, the exemplary embodiment of the rack 10 shown in FIGS. 1 and 3-6 is rotationally symmetric at 180 degrees, in part aligning open ends (see the discussion of FIG. 7 provided below) of stacked racks.

The leg assemblies 16 each include a leg footer 20, a leg member 22 and a slider pivot bearing (see FIGS. 2A and 2B), which joins the leg footer and leg member together with two degrees of freedom. Each leg assembly 16 is fixed to the shelf perimeter 18 at its leg footer 20. When in the upright position (as shown in FIGS. 1 and 3-6), the proximal end of the leg member 22 fits within the proximal end of the corresponding leg footer 20. Therefore, at least a portion of the leg footer 20 must be sufficiently open at its proximal end so that the proximal end of the leg member 22 may be inserted and connected therein. Portions of the leg footer 20 and up to the entire leg member 22 may thus be constructed of solid material, although it is preferred that both the leg member 22 and the leg footer 20 are both formed of tubular (i.e., hollow) material to reduce the overall weight of the rack 10.

It is preferred that the leg member 22 be formed as an elongate square- or rectangular-shaped body, but those skilled in the art will recognize that other shapes are readily employed. Regardless of the leg member shape, the leg member will have a maximum leg member width that must be accommodated by the leg footer as further defined below.

Figure 7:
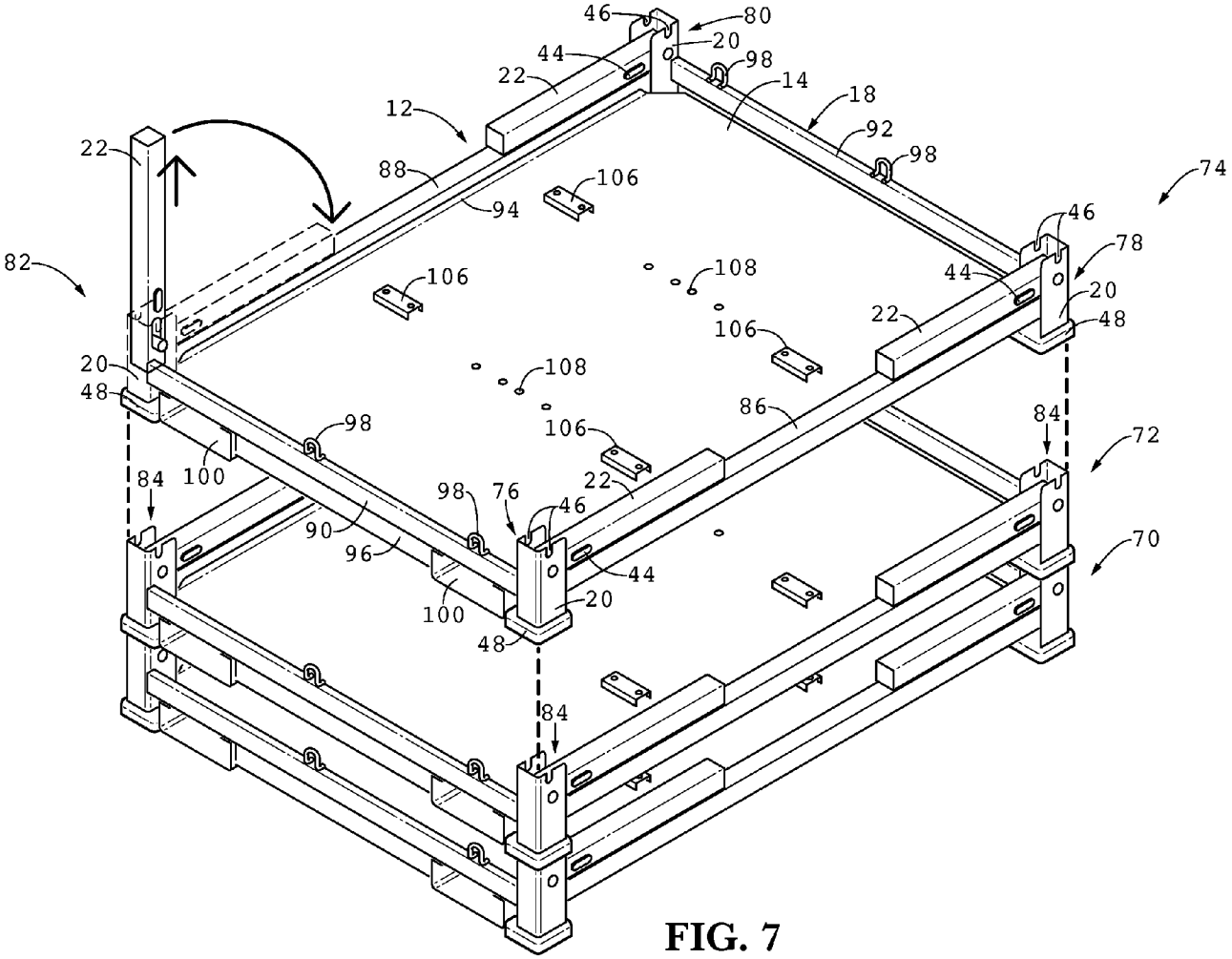
FIG. 7 is a perspective view of two exemplary racks of a second embodiment stacked and in the collapsed and position and a third exemplary rack between the upright and collapsed position.

The proximal end of the leg footer 20 also includes a horizontal opening so that the leg member 22 may be rotated into the collapsed position without interference from the leg footer 20 structure, thereby extending horizontally away from the leg footer 20 (see FIG. 7). The horizontal opening may be embodied as a bearing bracket situated at the proximal end of the leg footer, which serves as the slider pivot bearing connection point for the leg footer and permits movement of the leg member between the upright and collapsed position. For the purposes of this disclosure, a "bearing bracket" is defined as at least two opposing sides of a leg footer at its proximal end spaced apart so as to receive the proximal end of the leg member therebetween. It is preferred that a bearing bracket have at least one additional side connecting the opposing sides in order to prevent leg member rotation outwardly from the rack. Bearing brackets may be welded or fastened onto the proximal end of the leg footer, or—for leg footers that are constructed from tubular structures, three-sided U-channel shells or the like—the bearing bracket may simply be embodied as an integral portion of the leg footer body.

The leg footer 20 may optionally and preferably be provided as a three-sided U-channel shell having two parallel sides defining an interior diameter greater than the maximum leg member width, a perpendicular side joining the two parallel sides, and an open side, as shown in FIGS. 1-6. The bearing bracket in this exemplary embodiment encompasses the proximal ends of the two parallel sides 24 and the perpendicular side 26, and is sized to receive the proximal end of the leg member 22 therein. If the rack is intended for carrying heavy articles such as transmissions, engine blocks or the like, it is preferable that the rack components are constructed of aluminum or steel alloy, but other materials such as lightweight but durable plastic, metals, alloys or combinations thereof may be used, as will be readily apparent to those skilled in the art. In preferred embodiments square steel tubing is used to form the leg footers and members, however the use of a particular material is not intended nor considered to be limiting herein.

The slider pivot bearing consists of the features that join the proximal ends of each leg footer 20 and leg member 22 in a leg assembly 16 thereby allowing rotational motion of the leg member 22 with respect to the leg footer 20, and linear motion of either the leg footer 20 or the leg member 22 with respect to the other. That is, the slider pivot bearing permits axial rotation of the leg member 22 about a pivot axis, and further permits linear motion of either the leg footer 20 or the leg member 22 with respect to the pivot axis, depending on the configuration. The location of a pivot axis for one of the leg assemblies in FIG. 1 is illustrated by the broken line 28 extending through the proximal ends of the leg footer and leg member. A slider pivot bearing includes a journal, or other such friction bearing surface that is in contact with a linear bearing surface and a circular bearing surface in order to constrain movement of the leg assembly components to the two degrees of freedom described above.

Preferably, a shaft pin 30 coaxial with the pivot axis 24 carries the journal surface that contacts the linear and circular bearing surfaces and joins the proximal ends of the leg footers 20 and leg members 22. The shaft pin 30 is shown generally as a capped axle secured through the leg footers 20 and the leg members 22, and may comprise a locking pin, grooved clevis pin and retaining clamp configuration, axle and tension or cotter pin configuration, self-locking pin/axle, welded pin or the like. A preferred embodiment utilizes a welded pin for the shaft pin. Alternatively, as opposed to the preferred method of connecting the leg footer and member together with a separate pin secured through the components of the leg assembly, an axle may be fixed with respect to either the leg footer or the leg member in either a single or split axle configuration.

Figure 2B:
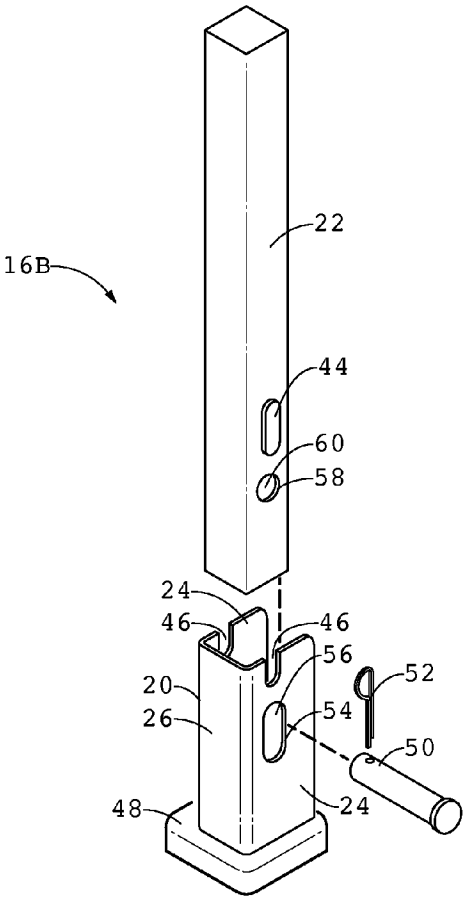
FIG. 2B is an exploded view of a second exemplary embodiment of the slider pivot bearing.
Figure 2A:
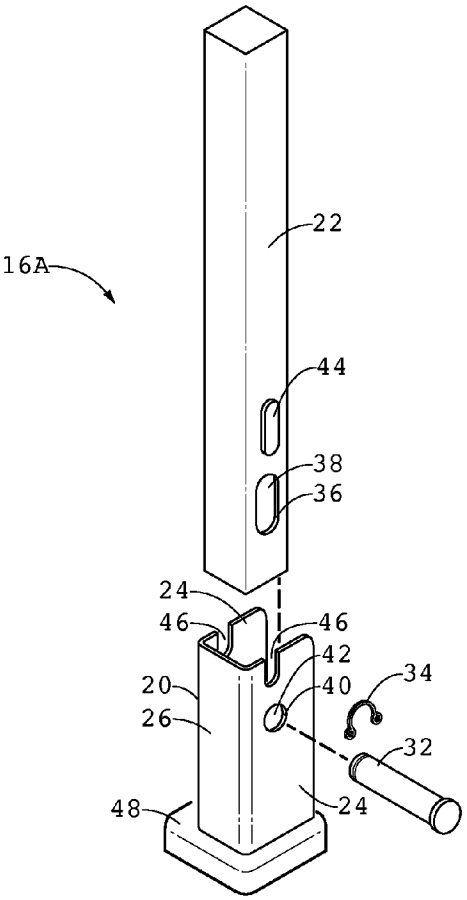
FIG. 2A is an exploded view of a first exemplary embodiment of the slider pivot bearing.

Further details and optional exemplary embodiments of the slider pivot bearing are depicted in connection with FIGS. 2A and 2B. FIG. 2A is an exploded view of a first exemplary embodiment of the slider pivot bearing for leg assembly 16*a* in which the shaft pin is a grooved clevis pin 32 and retaining clip 34, the linear bearing surface 36 is the interior surface of a slot 38 through the leg member 22, and the circular bearing surface 40 is the interior surface of a hole 42 through the leg footer 20. The linear bearing surface 36 extends longitudinally along the sides of the leg member 22 and constrains the leg member 22 to linear motion with respect to the pin 32, as well as axial rotation about the pin 32. The circular bearing surface 40 of this embodiment is coaxial with the pivot axis, thereby fixing the pin 32 and constraining its movement with respect to the leg footer 20 to axial rotation only. Those skilled in the art will appreciate that in some embodiments the pin 32 may be fixed in all degrees of freedom with respect to the leg footer 20, if desired. The slider pivot bearing is assembled by inserting the proximal end of the leg member 22 into the interior of the leg footer 20 and securing the pin 32 through the hole 42 and slot 38 with the retaining clip 34.

In some embodiments of the invented rack, the leg members include at least one retaining tab 44 protruding from the side, and corresponding notches 46 in the proximal ends of the leg footer or its bearing bracket portion 20 shaped to receive the retaining tabs 44 to lock the slider pivot bearing against axial rotation when the leg member 22 is in the upright position. For added stability when in the upright position, it is preferred that two opposing retaining tabs 44 be employed on each leg member 22, for example one on each of the two opposing sides of a bearing bracket. Such opposing retaining tabs 44 are clearly depicted in the view shown in FIG. 3, for instance. Those skilled in the art will appreciate that a leg member retaining tab and the correspondingly-shaped leg footer notch can be any general shape so long as lowering the leg member while in a vertical position engages the retaining tab with the notch such that axial rotation of the leg member is prevented.

Some embodiments also include a stacking socket 48 at the distal end of the leg footer 20. The stacking socket 48 is a cavity sized for receiving the distal end of a leg member 22 when the rack 10 is stacked upon another similarly configured rack that is in the upright position, and the proximal end of a leg footer 20 when stacked upon another rack that is in the collapsed position. The stacking socket 48 is preferably provided as a flared end cap defining a cavity 49 and affixed at the distal end of the leg footer 20. The stacking socket 48 should provide a sufficient barrier to lateral movement (e.g., the stacking socket walls) of the rack 10 when stacked upon other similar racks to prevent tipping or sliding from stacked positions.

FIG. 2B is an exploded view of a second exemplary embodiment of a slider pivot bearing configuration for leg assembly 16*b*. Those skilled in the art will appreciate that other configurations may be employed to achieve the constraint of motion to the two degrees of freedom as disclosed herein, and the use of alternative axle and bearing surface configurations that are equivalent to those disclosed explicitly are considered encompassed by this disclosure. The leg assembly 16*b* in FIG. 2B similar to the leg assembly in 16*a* in FIG. 2A except that the former utilizes a clevis pin 50 and cotter pin 52 configuration to provide a journal for the linear and circular bearing surfaces. In this embodiment, the linear bearing surface 54 is the interior surface of a slot 56 through the leg footer 20, and the circular bearing surface 58 is the interior surface of a hole 60 through the leg member 22. This configuration linearly fixes the leg member 22 with respect to the pin 50, allowing the pin 50 linear motion along the vertically oriented slot 56 in the leg footer 20. As with the embodiment shown in connection with FIG. 2A, the leg member 20 may be lifted vertically from its upright position, whereby the pin 50 slides upwardly from the bottom to the top of the slot 56 until the retaining tabs 44 are no longer retained within the notches 46, and the leg member 22 is rotated to the collapsed position, extending horizontally away from the leg footer 20 (see FIG. 7).

FIG. 7 is a perspective view of two exemplary racks of a second embodiment 70 and 72 stacked and in the collapsed and position and a third exemplary rack 74 between the upright and collapsed position. The top rack 74 leg assemblies 76, 78 and 80 are configured similarly to that depicted in connection with FIG. 2A, and with the exception of leg assembly 82 are all in the collapsed position wherein the leg members 22 extend horizontally away from their corresponding leg footer 20. The arrows associated with the upright leg assembly 82 illustrate the process of collapsing the leg member 22, wherein it is lifted upwardly to clear the retaining tabs 44 from their notches 46 and then rotated down to rest on the shelf perimeter 18. The vertical broken lines between the top rack 74 and the middle rack 72 illustrate the stacking of the racks wherein the distal end 84 of the leg footers of the middle rack are received into the stacking sockets 48 of the top rack 74, which rests thereon.

The racks 70, 72 and 74 depicted in FIG. 7 also illustrate that some embodiments may be further provided with leg assembly pairs spaced apart about the shelf perimeter. The top rack 74, for example, is provided with two leg assembly pairs: a first pair formed by the front two leg assemblies 76 and 78, and a second pair formed by the back two leg assemblies 80 and 82. The leg assemblies in each leg assembly pair are joined together by a primary connecting frame element (e.g., 86 and 88) that forms a portion of the shelf perimeter 18. In a leg assembly pair, the leg assemblies are positioned so that each leg member 22 in the leg assembly pair rotates toward the opposing leg assembly and rests upon the primary connecting frame element when in the collapsed position. For the second leg assembly pair shown in FIG. 7, for instance, the back two leg assemblies 80 and 82 are connected by a primary connecting frame element 88 and the leg member 22 of the left leg assembly 82 collapses to rest along the primary frame element 88 toward the right leg assembly 80, and vise versa.

The use of primary connecting frame elements such as 86 and 88, wherein those elements form a portion of the shelf perimeter 18, is the preferred method of securing the leg assemblies to the shelf 12. The use of connecting frame elements in general is preferred to provide increased load carrying capacity and even distribution of the load among the leg assemblies. Further secondary connecting frame elements, such as 90 and 92 in FIG. 7 for instance, may be secured between perimetrically consecutive leg assembly pairs and form additional portions of the shelf perimeter 18. In embodiments for which connecting frame elements are employed (e.g., 86, 88, 90 and 92), it is preferred to affix those elements to the shelf 12 along each side to form the shelf perimeter 18. Preferred embodiments employ a lip 94 around top surface 14 of the shelf 12 welded to the primary (86 and 88) or secondary (90 and 92) connecting frame elements, or both—however those skilled in the art will appreciate that the manner of affixation may vary depending upon application and expected load characteristics. Furthermore, reinforcing frame elements, such as element 96 shown in FIG. 7, may be optionally included in some exemplary embodiments to assist in load distribution.

Traversing the perimeter 18 of the shelf 12, the use of inwardly-facing leg assembly pairs allows for one or more open sides ("open ends" in the case of four-sided embodiments), where an "open side" is a portion of the perimeter that is free of leg members when the leg assemblies are in a collapsed position. The top rack 74 in FIG. 7 exhibits open ends corresponding to secondary connecting frame elements 90 and 92. The existence of open ends in an embodiment allows for the attachment of optional features that may be used to secure parts to the racks for shipping and storage purposes, for example, including but not limited to tie-downs 98 for straps and the like. Such optional features may be permanently or temporarily affixed to the open ends without interfering with the leg members 22 when in the collapsed position. Alternatively, excluding any features on the open sides will permit free access to the parts on the shelf 12 without regard to leg assembly positioning.

Figure 6:
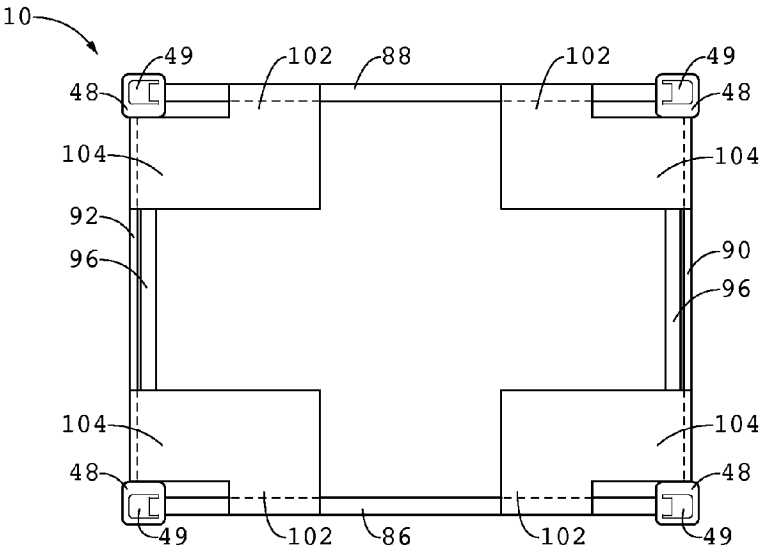
FIG. 6 is a bottom plan view of the exemplary rack.

Some embodiments are provided with one or more optional spaced apart fork guides. For example, the top rack 74 in FIG. 7 includes one set of spaced apart fork guides 100, affixed to the rack 74 in parallel beneath the shelf 12 and providing targets and support for the rack 74 to sit upon the forks of a traditional forklift apparatus used for moving the rack 74. The exemplary embodiment of the rack 10 shown in FIGS. 1 and 3-6 is alternatively provided with two pairs of spaced apart fork guides with one pair providing guides in the front-to-back position 102, and one pair providing guides in the side-to-side position 104. It should be noted that, the term "pair of spaced apart fork guides" does not require continuous guides, but may be provided as guides that are discontinuous across the bottom of the shelf 12 to lower the overall rack 10 weight (see FIG. 6, for instance). FIG. 6 is a bottom view of an exemplary embodiment depicting the use of two pairs of spaced apart fork guides.

It is preferred, as shown in the exemplary embodiments herein, to employ a four-sided rectangular shelf 12 with two primary connecting frame elements and two secondary connecting frame elements forming the shelf perimeter 18 so that, when several racks are stacked in the upright position, the leg assemblies of the top most rack may be collapsed, leaving two open ends as freely accessible to assembly line operations. Upon exhausting the parts held on the top most rack, the collapsed rack can be quickly removed and placed upon a second stack of collapsed racks out of the way of the assembly line operations. Such configurations are also useful in shipping and storage situations to permit unloaded racks to be stacked, stored or transported safely and with little floor space required.

It is further preferred to provide optional mounting brackets 106, interior tie-downs (similar to the tie-downs 98 in FIG. 7), mounting holes 108 or a combination thereof on the top surface of the rack 74, as in FIG. 7, in order to secure form fitting inserts (not shown) to the top surface 14 for temporary affixation of heavy parts or parts with non-uniform or curved bottom surfaces (e.g., transmission casings) to the shelf 12.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain some of the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A rack comprising:

a shelf having a single continuous top surface, a perimeter and a geometric center;

at least two leg assembly pairs spaced apart and distributed about the perimeter in rotational symmetry with respect to the geometric center, and wherein each leg assembly pair comprises a first leg assembly and a second leg assembly joined by a primary connecting frame element that is adjacent to a portion of the perimeter, each leg assembly comprising:

a leg member having an outer surface, a maximum leg member width, a proximal end and a distal end, comprising:

a bearing surface extending through the proximal end of the leg member; and a retaining tab protruding from the outer surface longitudinally between the bearing surface and the distal end of the leg member body;

a leg footer having a proximal end and a distal end, and affixed to the perimeter comprising:

a tubular shell body having an interior shape sized to receive the proximal end of the leg member;

a notch sized to receive the retaining tab formed in and open to the proximal end of the leg footer;

a bearing surface extending through the proximal end of the leg footer;

an opening in the leg footer extending longitudinally from the proximal end of the leg footer along all of the tubular shell body and having a transverse width greater than the maximum leg member width; and a stacking socket extending from the distal end of the leg footer sized to receive from a second rack for stacking thereon a distal end of a leg member or a proximal end of a leg footer; and a slider pivot bearing connecting the proximal end of the leg member to the proximal end of the leg footer comprising a shaft pin secured within the bearing surface of the leg footer and the bearing surface of the leg member wherein the proximal end of the leg member is contained within the tubular shell of the leg footer, the leg member being thereby movable between:

an upright position wherein the leg member extends vertically from the leg footer wherein the retaining tab is retained within the notch; and a collapsed position wherein the leg member is slid upward so that the retaining tab is released from the notch and the leg member is pivoted into a horizontal position, thereby extending horizontally from the opening in the leg footer body;

a secondary connecting frame element joining perimetrically adjacent leg assembly pairs in the at least two leg assembly pairs, and wherein the secondary connecting frame element is adjacent to a portion of the perimeter;

a pair of spaced apart fork guides affixed to the rack in parallel beneath the shelf; a plurality of tie-downs affixed to the rack;

a plurality of circular mounting holes through the shelf sized and adapted for receiving fasteners; and a plurality of mounting brackets affixed to the top surface of the shelf such that they protrude therefrom, wherein each mounting bracket is an inverted substantially U-shaped bracket having an generally planar upper surface with apertures there through.

2. The rack of claim 1, wherein the bearing surface of the leg footer comprises a circular bearing surface comprising an interior surface of a hole, and wherein the bearing surface of the leg member comprises a linear bearing surface comprising an interior surface of a slot, whereby the shaft pin is constrains the leg member to linear motion with respect to the shaft pin, and the leg footer and leg member are constrained to axial rotation about the shaft pin with respect to one another.

3. The rack of claim 1, wherein the bearing surface of the leg member comprises a circular bearing surface comprising an interior surface of a hole, and wherein the bearing surface of the leg footer comprises a linear bearing surface comprising an interior surface of a slot, whereby the shaft pin is constrained to linear motion with respect to the leg footer, and the leg footer and leg member are constrained to axial rotation about the shaft pin with respect to one another.

4. A rack comprising:

a shelf having a single continuous top surface and a first and second pair of parallel sides together forming a perimeter;

a pair of primary support structures, each comprising:

a pair of leg assemblies comprising:

a leg member having a proximal end and a distal end, comprising:

a leg member body having a pair of opposing sides each having an outer surface and together defining a maximum leg member width there between;

a pair of slots in the pair of opposing sides and extending longitudinally from the proximal end of the leg member; and a retaining tab protruding from the outer surface of each opposing side and located longitudinally between each slot and the distal end of the leg member;

a leg footer having a proximal end and a distal end, comprising:

a leg footer body comprising a U-channel shell having two parallel sides defining an interior diameter greater than the maximum leg member width, a perpendicular side joining the two parallel sides and an open side;

a notch sized to receive a retaining tab formed in and open to the proximal end of the leg footer on each parallel side of the leg footer body; a hole formed in the proximal end of the leg footer on each parallel side of the leg footer body; and a stacking socket at the distal end of the leg footer sized to receive from a second rack for stacking thereon a distal end of a leg member body or a proximal end of a leg footer body; and a slider pivot bearing securing the proximal end of the leg member within the proximal end of the leg footer comprising a shaft pin secured through each hole in the leg footer and each slot in the leg member wherein the proximal end of the leg member is contained within the leg footer, the leg member being thereby movable between:

an upright position wherein the leg member extends vertically from the leg footer wherein the retaining tabs are retained within the notches; and a collapsed position wherein the leg member is slid upward so that the retaining tabs are released from the notches and the leg member is pivoted into a horizontal position, thereby extending horizontally from the open side of the leg footer body; and a primary connecting frame element affixed between and joining the pair of leg assemblies to form the primary support structure, wherein the pair of primary support structures are each affixed to a side in the first pair of parallel sides of the shelf;

a pair of secondary connecting frame elements each affixed between and joining a leg assembly from each of the primary support structures, and wherein the pair of secondary connecting frame elements are each affixed to a side in the second pair of parallel sides of the shelf;

a pair of spaced apart fork guides affixed to the rack beneath the shelf and in parallel to the pair of secondary support structures;

a plurality of tie-downs affixed to the rack;

a plurality of mounting brackets affixed to the top surface of the shelf such that they protrude therefrom, wherein each mounting bracket is an inverted substantially U-shaped bracket having an generally planar upper surface with apertures there through; and wherein a plurality of circular mounting holes are formed through the shelf.

* * * * *